US006737622B1

(12) United States Patent
Jeong et al.

(10) Patent No.: US 6,737,622 B1
(45) Date of Patent: May 18, 2004

(54) WALL-MOUNTED TYPE MICROWAVE OVEN

(75) Inventors: Sang-Jin Jeong, Suwon (KR); Sang-Seok Seo, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/441,197

(22) Filed: May 20, 2003

(30) Foreign Application Priority Data

Dec. 16, 2002 (KR) ..... 10-2002-0080188

(51) Int. Cl.[7] ..... H05B 6/80
(52) U.S. Cl. ..... 219/756; 219/702; 126/273 A
(58) Field of Search ..... 219/756, 757, 219/702, 715; 126/21 R, 21 A, 273 A, 275 E

(56) References Cited

U.S. PATENT DOCUMENTS 5,818,015 A * 10/1998 Lee et al. ..... 219/723
6,660,984 B1 * 12/2003 Jeong et al. ..... 219/757

FOREIGN PATENT DOCUMENTS

KR 99032460 * 5/1999
KR 2000010025 * 2/2000
KR 10-0353358 7/2001

* cited by examiner

*Primary Examiner*—Philip H. Leung
(74) *Attorney, Agent, or Firm*—Staas & Halsey LLP

(57) ABSTRACT

A wall-mounted type microwave oven includes a casing defining an external appearance of the microwave oven. A power cord passes through an upper panel, which defines a top wall of the casing, to supply an external electrical power into the casing. A mounting hole is formed at the upper panel of the casing so as to be opened at a rear end of the upper panel, thus allowing the power cord to pass through the upper panel. A locking unit is provided at a predetermined portion of the power cord to engage with the mounting hole, thus locking the power cord to engage with the mounting hole, thus locking the power cord to upper panel. A rear panel defines a rear wall of the casing and supports a rear end of the locking unit. The wall-mounted type microwave oven is designed such that the locking unit is locked to the upper panel without additional components.

23 Claims, 5 Drawing Sheets

WALL-MOUNTED TYPE MICROWAVE OVEN

CROSS-REFERENCE TO RELATED APPLICATIONS

This application claims the benefit of Korean Application No. 2002-80188, filed Dec. 16, 2002, in the Korean Intellectual Property Office, the disclosure of which is incorporated herein by reference.

BACKGROUND OF THE INVENTION

1. Field of the Invention

The present invention relates, in general, to wall-mounted type microwave ovens and, more particularly, to a wall-mounted type microwave oven which is designed to allow a power cord to be easily and efficiently mounted to the microwave oven.

2. Description of the Related Art

As is well known to those skilled in the art, a wall-mounted type microwave oven is installed above an oven range, in a kitchen. The wall-mounted type microwave oven serves to exhaust gas or smoke produced from the oven range which is positioned under the microwave oven, in addition to cooking food by microwaves in the wall-mounted type microwave oven.

The wall-mounted type microwave oven includes a casing which defines an external appearance thereof. A cooking cavity and a machine room are provided in the casing and separated from each other by a partition wall. An internal duct is provided outside of the cooking cavity and of the machine room in the casing to vent the exhaust gas or the smoke, produced from the oven range which is positioned under the wall-mounted type microwave oven, to the atmosphere.

The internal duct extends around lower portions, rear portions, and upper portions of the cooking cavity and the machine room. An air inlet port is formed at a bottom panel of the casing to suck the exhaust gas or the smoke into the casing. An exhaust fan is provided on an upper portion of the casing, and operates to discharge the exhaust gas and the smoke, which are sucked into the casing via the air inlet port and the internal duct, to the atmosphere.

In the wall-mounted type microwave oven, a power cord is installed to pass through the casing, and operates to supply electric power to a power supply unit which is provided in the casing. In this case, the power cord passes through an upper panel which defines a top wall of the casing.

Since a rear wall of the casing is mounted close to a wall of a kitchen and a side wall of the casing is mounted close to a cupboard to store kitchen utensils, the power cord is not mounted to the rear wall or the side wall of the casing but is mounted to the upper panel of the casing. When the power cord is installed to pass through a bottom wall of the casing, the power cord may be thermally deformed due to heat generated by the oven range which is positioned under the microwave oven.

As illustrated in FIGS. 1 and 2, a mounting hole 4 is formed at a predetermined portion of an upper panel 2 which defines a top wall of a casing 1, so that a power cord 3 is installed to pass through the upper panel 2 of the casing 1.

A plug 3*a* is provided at an end of the power cord 3 which is outside the mounting hole 4, and is connected to an external power source. A locking unit 5 is provided at a predetermined portion of the power cord 3 to lock the power cord 3 to the upper panel 2.

The locking unit 5 is provided around a circumferential surface thereof with a locking groove 5*a*, thus engaging with the mounting hole 4 at the locking groove 5*a*. The mounting hole 4 is provided with a locking notch 4*a*, so that the locking groove 5*a* of the locking unit 5 engages with an edge of the locking notch 4*a*.

Further, the mounting hole 4 is provided with a guide opening 4*b*. The guide opening 4*b* has a width larger than the locking unit 5 to easily guide the locking unit 5 into the locking notch 4*a*. That is, the locking unit 5 engages with the edge of the locking notch 4*a* through the guide opening 4*b* of the mounting hole 4.

When the locking unit 5 engages with the edge of the locking notch 4*a*, the guide opening 4*b* is open. Thus, contaminants, such as dust, may flow into the casing 1 through the open guide opening 4*b*.

To prevent the contaminants, such as dust, from flowing into the casing 1 through the mounting hole 4 and to engage the locking unit 5 to the mounting hole 4, a cover 6 is mounted to the mounting hole 4. The cover 6 is fastened to the upper panel 2 using a fastener, such as a setscrew, thus covering the mounting hole 4. A stopper 6*a* is provided at an end of the cover 6 to surround a part of an upper surface and a side surface of the locking units, thus preventing the locking unit 5 from being unexpectedly removed from the locking notch 4*a*.

However, the conventional wall-mounted type microwave oven has a problem that components, such as a cover, are additionally required, so a manufacturing cost is increased, The conventional wall-mounted type microwave oven has another problem that the cover is fastened to a casing using a setscrew, so its assembling efficiency is poor.

SUMMARY OF THE INVENTION

Accordingly, it is an aspect of the present invention to provide a wall-mounted type microwave oven which reduces a number of required components, thus reducing a manufacturing cost of the wall-mounted type microwave oven, and enhancing an assembling efficiency of the wall-mounted type microwave oven.

Additional aspects and/or advantages of the invention will be set forth in part in the description which follows and, in part, will be obvious from the description, or may be learned by practice of the invention.

The above and/or other aspects of the present invention are achieved by providing a wall-mounted type microwave oven, including a casing defining an external appearance of the wall-mounted type microwave oven, a power cord passing through an upper panel, which defines a top wall of the casing to supply external electrical power into the casing, and a mounting hole formed at the upper panel of the casing so as to be opened at a rear end of the upper panel, thus allowing the power cord to pass through the upper panel. The wall-mounted type microwave oven also includes a locking unit provided at a predetermined portion of the power cord to engage with the mounting hole, thus locking the power cord to the upper panel, and a rear panel defining a rear wall of the casing and supporting a rear end of the locking unit.

The locking unit is provided around a circumferential surface thereof with a locking groove, thus engaging with the mounting hole at a locking groove. The mounting hole includes a locking notch having a width corresponding to the locking groove so that the locking groove of the locking unit engages with an edge of the locking notch, and a guide opening having a width larger than the locking unit to guide the locking unit into the locking notch.

Further, a support rib forwardly extends along an upper edge of the rear panel to support the rear end of the locking unit and close the guide opening.

The locking unit includes upper and lower bodies of a rectangular plate shaped so as to define the locking groove between the upper and lower bodies.

The upper panel is depressed downwardly at a portion around the locking notch, thus preventing the upper body of the locking unit from being projected from the upper panel of the casing.

Further, the locking unit is integrated with the power cord.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
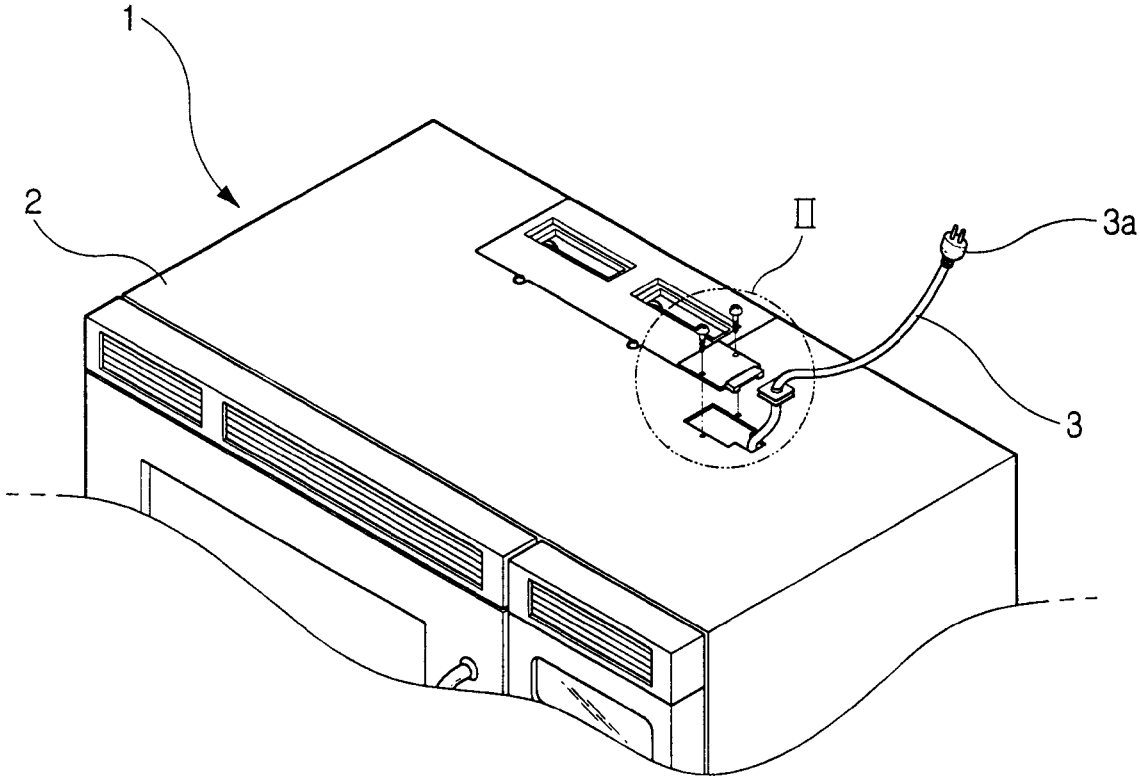
FIG. 1 (PRIOR ART)
FIG. 1 is a perspective view illustrating a part of a conventional wall-mounted type microwave oven.
Figure 2:
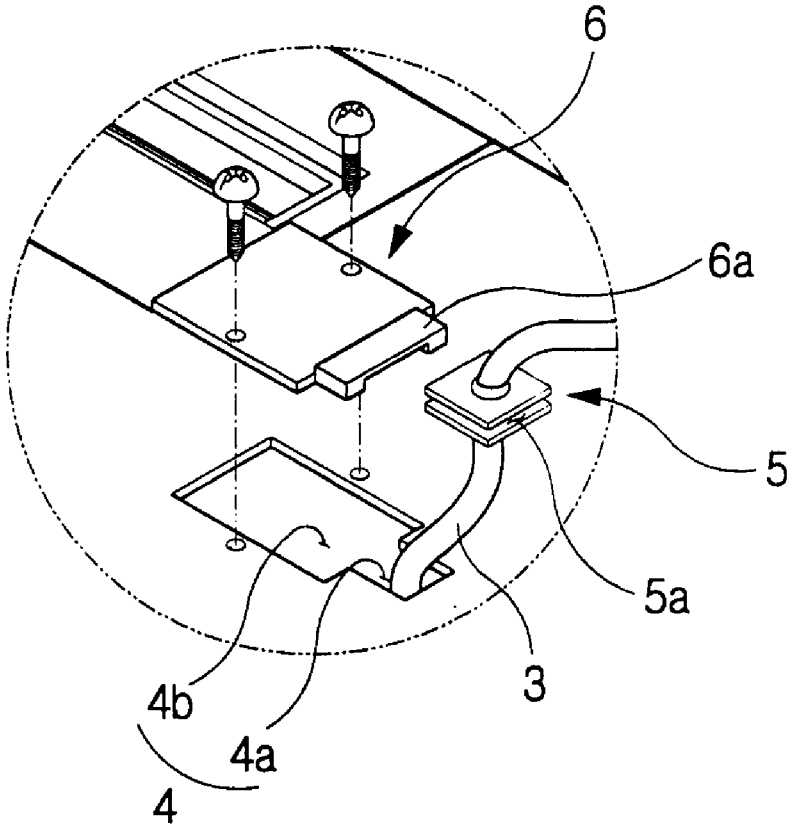
FIG. 2 (PRIOR ART)
FIG. 2 is an enlarged view of the area II in FIG. 1.

Reference will now be made in detail to the present embodiment of the present invention, examples of which are illustrated in the accompanying drawings, wherein like reference numerals refer to like elements throughout.

Figure 3:
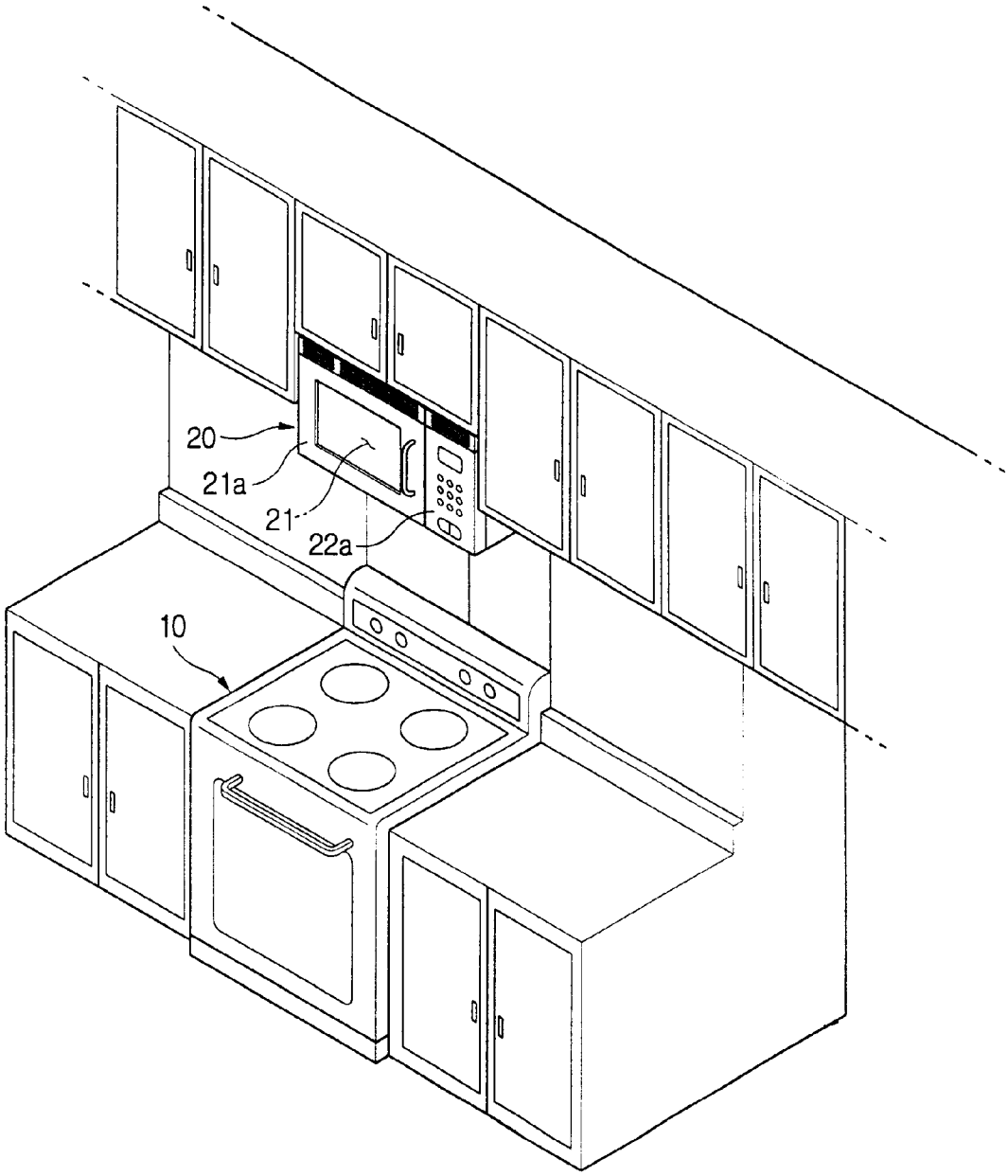
FIG. 3 is a perspective view illustrating a wall-mounted type microwave oven, according to an embodiment of the present invention, with the wall-mounted type microwave oven being installed above an oven range.

As illustrated in FIG. 3, a wall-mounted type microwave oven according to an embodiment of the present invention is installed above an oven range 10 in a kitchen. An external duct (not shown) is installed at a predetermined position above the wall-mounted type microwave oven, and operates to guide exhaust gas, smoke and food odors, which are produced from the oven range 10, to an outside of the kitchen.

The wall-mounted type microwave oven includes a casing 20 which defines an external appearance of the wall-mounted type microwave oven. A cooking cavity 21 and a machine room 22 (see FIG. 4) are provided in the casing 20 and separated from each other by a partition wall. Food to be cooked is placed in the cooking cavity 21. Several electrical devices are installed in the machine room 22.

A door 21*a* is mounted to a front of the cooking cavity 21 to selectively open or close the cooking cavity 21. A control panel 22*a* is provided on a front of the machine room 22 next to the door 21*a* of the cooking cavity 21 to control the operations of the wall-mounted type of microwave oven.

Figure 4:
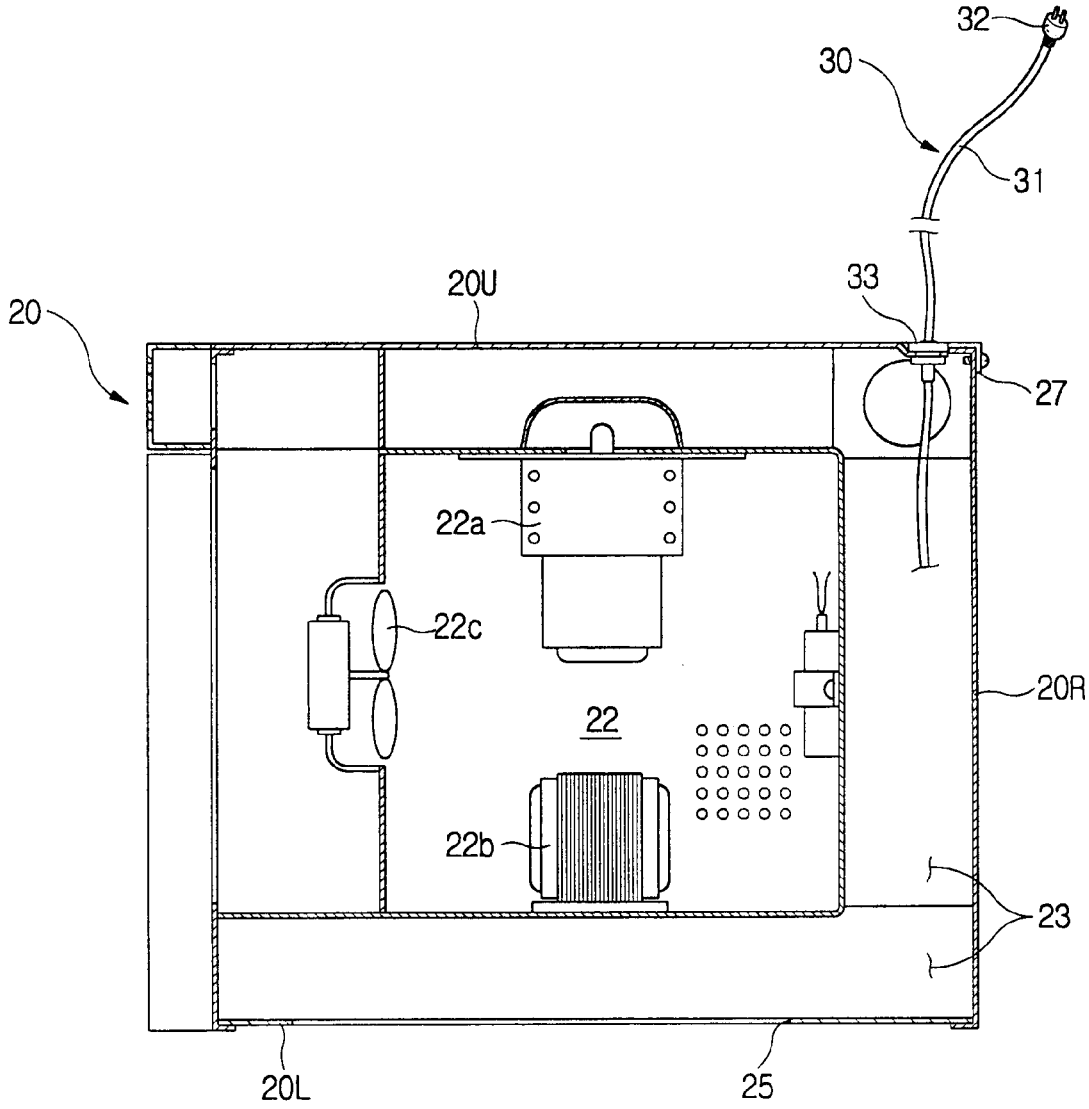
FIG. 4 is a sectional view illustrating the wall-mounted type microwave oven, according to the embodiment of the present invention.

As illustrated in FIG. 4, several electrical devices, including a magnetron 22*d* and a high-voltage transformer 22*b*, and a cooling fan 22*c* to cool the electrical devices are installed in the machine room 22. The magnetron 22*d* irradiates microwaves into the cooking cavity 21. The high-voltage transformer 22*b* applies a high voltage to the magnetron 22*d*.

Two air inlet ports 25 are formed at respective sides on a lower panel 20L which defines a bottom wall of the casing 20, so that contaminated indoor air with exhaust gas, smoke and food odors, produced from the oven range 10, is sucked into the casing 20 through the air inlet ports 25. An air outlet port (not shown) is formed on an upper panel 20U which defines a top wall of the casing 20, so that the contaminated indoor air sucked through the air inlet ports 25 is discharged from the casing 20 through the air outlet port.

An internal duct 23 is provided in the casing 20 to guide indoor air from two air inlet ports 25 to the air outlet port. The internal duct 23 extends around the lower portions, rear portions, and upper portions of the cooking cavity 21 and the machine room 22, so that indoor air sucked into the casing 20 through the two air inlet ports 25 is guided to the air outlet port.

The wall-mounted type microwave oven is provided with a power cord 30. The power cord 30 is connected to an external power source to supply electrical power to the electrical devices installed in the casing 20.

The power cord 30 is installed to pass through the casing 20 to connect a power supply unit (not shown) which is provided in the casing 20 to the external power source, thus supplying the electrical power to the electrical devices installed in the casing 20. The power cord 30 is provided with a cable 31 and a plug 32. In this case, the cable 31 is installed to pass through the casing 20, and the plug 32 is connected to the external power source.

Figure 5:
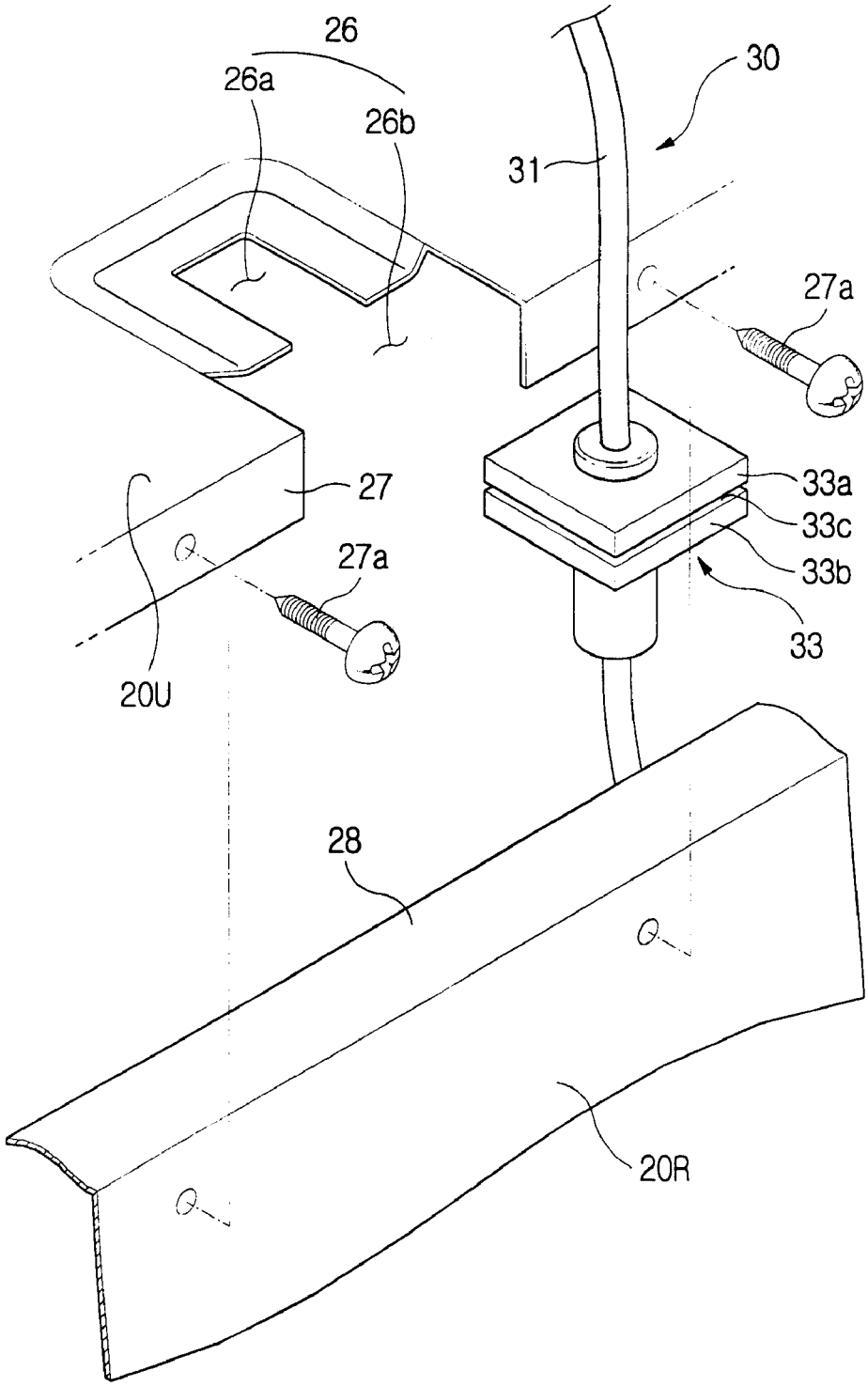
FIG. 5 is an exploded perspective view illustrating the wall-mounted type microwave oven, according to the embodiment of the present invention, with a locking unit engaging with a mounting hole formed at an upper panel of a casing.

As shown in FIG. 5, a mounting hole 26 is formed at the upper panel 20U which defines the top wall of the casing 20 so as to be opened at a rear end of the upper panel 20U, thus allowing the power cord 30 to pass through the upper panel 20U.

A locking unit 33 is provided at a predetermined portion of the power cord 30 to lock the power cord 30 to the casing 20, thus preventing the cable 31 from being disconnected from a connecting part of the power supply unit, even though an external force is applied to the power cord 30.

The locking unit 33 is provided at a predetermined portion of the cable 31, and engages with the mounting hole 26 which is formed at the upper panel 20U of the casing 20. Thus, even though an external force is applied to the plug 32 and the external force is transmitted to the locking unit 31 via the cable 31, the external force is absorbed at the upper panel 20U. As a result, even though an external force is applied to the power cord 30, the cable 31 is not undesirably disconnected from the connecting part of the power supply unit.

The locking unit 33 includes upper and lower bodies 33*a* and 33*b*. The upper and lower bodies 33*a* and 33*b* have a rectangular plate shape, and are arranged in a vertical row. A locking groove 33*c* is provided around a circumferential surface of the locking unit 33 between the upper and lower bodies 33*a* and 33*b*, so that the locking unit 33 engages with the upper panel 20U at the locking groove 33*c*.

The mounting hole 26 includes a locking notch 26*a*, and a guide opening 26*b*. The locking notch 26*a* has a width corresponding to the locking groove 33*c* of the locking unit 33 so that the locking groove 33*c* engages with an edge of the locking notch 26*a*. The guide opening 26*b* has a width larger than the locking unit 33 to guide the locking unit 33 into the locking notch 26*a*.

Thus, as the locking unit 33 is moved toward the locking notch 26*a* through the guide opening 26*b*, the locking groove 33*c* of the locking unit 33 engages with the edge of the locking notch 26*a*. At this time, the locking groove 33*c* is supported by the edge of the locking notch 26*a*, thus preventing the locking unit 33 from being moved in a vertical direction.

The upper panel 20U is depressed downwardly at a portion around the locking notch 26*a*, thus supporting a front portion and respective side portions of the upper body 33*a* of the locking unit 33, and preventing the upper body 33*a* of the locking unit 33 from projecting from the upper panel 20U of the casing 20 when the locking unit 33 engages with the mounting hole 26.

The upper panel 20U with the locking unit 33 is assembled with a rear panel 20R which defines the rear wall of the casing 20, thus forming the casing 20. To easily assemble the upper panel 20U with the rear panel 20R, a mounting rib 27 extends downwardly along a rear end of the upper panel 20U. That is, the upper panel 20U is firmly assembled with the rear panel 20R by fixing the rear panel 20R to the mounting rib 27 of the upper panel 20U using a fastener, such as a setscrew 27*a*.

As described above, the mounting hole 26 is formed at the upper panel 20U of the casing 20 so as to be opened at the rear end of the upper panel 20U. Thus, when the rear panel 20R is assembled with the upper panel 20U, the locking unit 33 engaging with the mounting hole 26 is supported at the rear end thereof by the rear panel 20R, thus preventing the locking unit 33 from being undesirably removed from the mounting hole 26.

Further, a support rib 28 extends forwardly along an upper edge of the rear panel 20R. When the rear panel 20R is assembled with the upper panel 20U, the support rib 28 of the rear panel 20R is placed on an upper surface of the upper panel 20U, thus supporting a rear end of the locking unit 33 and closing the guide opening 26*b*.

That is, since the locking groove 33*c* of the locking unit 33 engages with the edge of the locking notch 26*a*, the locking unit 33 is not moved upward or downward. Further, the rear end of the locking unit 33 is supported by the rear panel 20R, thus preventing the locking unit 33 from being undesirably removed from the mounting hole 26. Therefore, the locking unit 33 is stably and reliably locked to the upper panel 20U of the casing 20.

The locking unit 33 may be integrated with the power cord 30.

The assembly and operational effect of the wall-mounted type microwave oven according to the embodiment of the present invention will be described in the following in detail with reference to FIGS. 3 to 5.

First, the power cord 30 with the locking unit provided at the predetermined portion of the power cord is installed to pass through the mounting hole 26 which is formed at the upper panel 20U of the casing 20. Next, the locking unit 33 provided at the predetermined portion of the power cord 30 is forwardly moved through the guide opening 26*b* until the locking groove 33*c* of the locking unit 33 engages with the edge of the locking notch 26*a* of the mounting hole 26.

When the rear panel 20R is fastened to the upper panel 20U at the mounting rib 27, which is provided along the rear end of the upper panel 20U, the support rib 28 of the rear panel 20R supports the rear end of the locking unit 33 and closes the guide opening 26*b*.

When the wall-mounted type microwave oven is assembled in this way, the locking groove 33*c* of the locking unit 33 engages with the edge of the locking notch 26*a*, so the locking unit 33 is not moved upward or downward. Further, the rear end of the locking unit 33 is supported by the rear panel 20R, thus preventing the locking unit 33 from being undesirably removed from the mounting hole 26. Therefore, the locking unit 33 is stably and reliably locked to the upper panel 20U of the casing 20.

As apparent from the above description, the present invention provides a wall-mounted type microwave oven with a locking unit provided at a predetermined portion of a power cord, locked to an upper panel without additional components and stopped by a rear panel, and a guide opening of a mounting hole is closed by a support rib which is provided at the rear panel, thus reducing a manufacturing cost of wall-mounted type microwave oven and enhancing an assembling efficiency of the microwave oven.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A wall-mounted type microwave oven, comprising:

a casing defining an external appearance of the wall-mounted type microwave oven and having upper and rear panels;

a power cord passing through the upper panel of the casing to supply external electrical power into the casing, the upper panel defining a top wall of the casing;

a mounting hole formed at the upper panel of the casing so as to be opened at a rear end of the upper panel, allowing the power cord to pass through the upper panel;

a locking unit provided at a predetermined portion of the power cord to engage with the mounting hole, to lock the power cord to the upper panel; and a rear panel defining a rear wall of the casing and the rear panel supporting a rear end of the locking unit.

2. The wall-mounted type microwave oven according to claim 1, wherein:

the locking unit is provided around a circumferential surface thereof with a locking groove to engage with the mounting hole at the locking groove, and the mounting hole comprises:

a locking notch having a width corresponding to the locking groove so that the locking groove of the locking unit engages with an edge of the locking notch; and a guide opening having a width larger than the locking unit to guide the locking unit into the locking notch.

3. The wall-mounted type microwave oven according to claim 2, further comprising:

a support rib extending along an upper edge of the rear panel to support a rear end of the locking unit and to close the guide opening.

4. The wall-mounted type microwave oven according to claim 2, wherein the locking unit comprises:

upper and lower bodies in a shape of a rectangular plate so as to define the locking groove between the upper and lower bodies.

5. The wall-mounted type microwave oven according to claim 4, wherein the upper panel is depressed at a portion around the locking notch to prevent the upper body of the locking unit from projecting from the upper panel of the casing.

6. The wall-mounted type microwave oven according to claim 1, wherein the locking unit is integrated with the power cord.

7. A wall-mounted type microwave oven with a case having upper and rear panels, the upper and rear panels defining top and rear walls, respectively, of the casing, comprising:

a power cord passing through the upper panel of the casing to supply power into the casing;

a mounting hole formed at a rear end of the upper panel of the casing allowing the power cord to pass through the upper panel; and a locking unit provided at a predetermined portion of the power cord to engage with the mounting hole, to lock the power cord to the upper panel, the rear panel supporting a rear end of the locking unit.

8. The wall-mounted type microwave oven according to claim 7, wherein:

the locking unit comprises:

a groove around a circumferential surface thereof; and the mounting hole comprises:

a notch having a width corresponding to a width of the groove; and a guide opening having a width larger than the locking unit to guide the locking unit into the notch so that the groove of the locking unit slidable engages with the notch.

9. The wall-mounted type microwave oven according to claim 8, wherein the locking unit comprises:

upper and lower bodies to define the groove therebetween to engage at a top surface and a bottom surface of the upper panel of the casing.

10. The wall-mounted type microwave oven according to claim 9, wherein the upper panel of the casing is depressed at a portion around the notch to prevent the upper body of the locking unit from projecting above a level of the remaining portion of the upper panel of the casing.

11. The wall-mounted type microwave oven according to claim 9, wherein the upper and lower bodies have a rectangular plate shape, and are arranged in a vertical row.

12. The wall-mounted type microwave oven according to claim 8, wherein when the locking unit is moved toward the notch through the guide opening, the groove of the locking unit engages with the edge of the locking notch and the locking groove is supported by an edge of the notch to prevent the locking unit from being moved in a vertical direction.

13. The wall-mounted type microwave oven according to claim 8, wherein the groove is around three sides of the locking unit.

14. The wall-mounted type microwave oven according to claim 8, wherein the groove is sloped in a downward direction so as not to project above a level of the remaining portion of the upper panel of the casing.

15. The wall-mounted type microwave oven according to claim 8, wherein the groove and rear panel support all four sides of the locking unit.

16. The wall-mounted type microwave oven according to claim 7, wherein the guide opening is positioned at an edge of the top of the casing to allow the locking unit to slide into the guide opening from a rear of the casing.

17. The wall-mounted type microwave oven according to claim 16, wherein the rear panel closes an open edge of the guide opening when the locking unit is slid into the guide opening and the rear panel supports the locking unit adjacent thereto.

18. The wall-mounted type microwave oven according to claim 7, wherein the rear panel locks the locking unit in place.

19. The wall-mounted type microwave oven according to claim 7, further comprising:

a rib extending along an upper edge of the rear panel to support the rear end of the locking unit and to close the guide opening.

20. The wall-mounted type microwave oven according to claim 7, wherein the locking unit is integrated with the power cord.

21. The wall-mounted type microwave oven according to claim 7, wherein when an external force is applied to the power cord, the external force is transmitted to the locking unit and absorbed by the upper panel.

22. The wall-mounted type microwave oven according to claim 7, further comprising:

a rib extending along a side edge of the upper panel; and a fastener fastening the upper panel with the rear panel by the rib.

23. A wall-mounted type microwave oven with a case having a rear wall, comprising:

a power cord passing through the casing to supply power into the casing;

a mounting hole formed at a top of the casing allowing the power cord to pass therethrough; and a locking unit provided on the power cord to slidably attach to the mounting hole from a rear of the casing and locked by the rear wall.

* * * * *